US005149476A

United States Patent [19]

Sedman

[11] Patent Number: 5,149,476

[45] Date of Patent: Sep. 22, 1992

[54] APPLICATOR TRAP GUIDE

[75] Inventor: Benny M. Sedman, Laurens, S.C.

[73] Assignee: AlSiMag Technical Ceramics, Inc., Laurens, S.C.

[21] Appl. No.: 813,988

[22] Filed: Dec. 26, 1991

Related U.S. Application Data

[62] Division of Ser. No. 571,086, Aug. 22, 1990.

[51] Int. Cl.[5] ..... C04B 35/64; C04B 41/53

[52] U.S. Cl. ..... 264/67; 264/118

[58] Field of Search ..... 264/67, 118

[56] References Cited

U.S. PATENT DOCUMENTS

| | | | |
|---|---|---|---|
| 852,073 | 4/1907 | Mitchell | 242/157 R |
| 906,543 | 12/1908 | Mitchell | 242/157 R |
| 1,665,063 | 4/1928 | Magrath | 242/157 R |
| 2,000,405 | 5/1935 | McHale | 242/157 R |
| 2,202,937 | 6/1940 | Wolfe | 242/157 R |
| 3,499,066 | 3/1970 | Murray | 264/56 |
| 4,185,061 | 1/1980 | Hinton | 264/67 |
| 4,268,550 | 5/1981 | Williams | 118/420 X |
| 4,481,235 | 11/1984 | Foell | 118/420 X |
| 5,019,307 | 5/1991 | Brewer | 264/67 |

*Primary Examiner*—James Derrington
*Attorney, Agent, or Firm*—Bailey & Hardaway

[57] ABSTRACT

An applicator trap guide is used to guide and coat newly synthesized synthetic filaments with a protective coating. The trap guide secures the filament against slippage while allowing rapid insertion of a filament into the trap guide and providing visual monitoring of the coating process.

1 Claim, 2 Drawing Sheets

APPLICATOR TRAP GUIDE

This application is a division of application Ser. No. 07/571,086, filed Aug. 22, 1990.

BACKGROUND OF THE INVENTION

This invention relates to the art of textile applicator thread guides and more particularly to the art of a guide which enables spinneret produced filaments, such as nylon, rayon or fiberglass, to be given a protective coating prior to twisting into larger strands.

Applicator guides in the prior art are V-shaped pieces whose flared outer arms direct filaments over a small spray outlet in the base of the guide. As the filaments pass over the spray outlet, a protective finish is applied to the filament. Without the protective finish, the filament is unusable.

A disadvantage of current guides is the tendency for the filaments to slip out of the guide arms. When this occurs, the event is often not detected immediately. As a result, the uncoated filaments are further processed into larger strands. If these larger strands with uncoated filaments are incorporated into a finished product, the product in unusable. As a result, a costly finished product may be ruined by an untreated filament which slipped out of position of the Applicant's guide arms.

Efforts to enclose the thread guides to prevent the filaments from slipping have not met with success. Enclosures require that the filaments be manually threaded rather than slipped into position, adding to the labor costs and equipment down time. Enclosed filament guides also prevent visual monitoring of the coating process. Further, some enclosed filament guides within the existing art are difficult to manufacture from ceramic, the preferred material of choice for long-wearing thread guides.

To date, there has been no effective way to provide a long wearing filament guide which prevents slippage of the filaments from the guide yet still provides for filament placement into the guide along with visual monitoring of the coating process. Therefore, much room for improvement in the art exists.

SUMMARY OF THE INVENTION

Thus, it is an object of this invention to provide an applicator trap guide for directing spinneret produced filaments over a source of a protective coating.

It is a further object of this invention to provide an applicator trap guide which secures the filament against accidental slippage or disengagement from the applicator trap guide.

It is a further object of this invention to provide an applicator trap guide which allows visual monitoring of the coating process.

It is a still further object of this invention to provide a method of manufacturing an applicator trap guide from ceramic.

These as well as other objects of the invention are accomplished by an applicator trap guide comprising an upper guide block and a lower peg with a bore traversing the peg and the bore in communication the upper guide block; a filament chamber for directing a filament over the peg bore and traversing the guide block; and a diagonal fluted sleeve traversing the guide block and in communication with the subtending filament chamber.

DETAILED DESCRIPTION

In accordance with this invention, it has been found that an applicator trap guide can be used to secure and protectively coat filaments of nylon, rayon, fiberglass, and other spinneret manufactured material which prevents the filaments from slipping out of the guide surface. Furthermore, the invention provides for a method of manufacturing the trap guide from ceramic.

Figure 1:
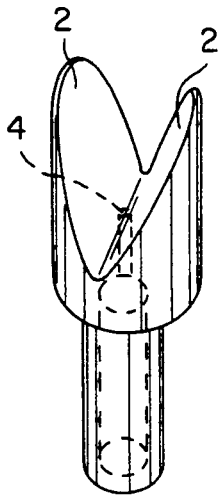
FIG. 1 PRIOR ART
FIG. 1 is a perspective view partially in phantom of a representative example of the prior art in applicator guides.

FIG. 1 illustrates an example of the prior art in application guides. A filament passing between the flared outer arms 2 is directed to a source of protectant from nozzle 4. A common and costly problem results when the filament escapes from the guiding arm of the applicator. As a result, the filament lacks the protective coating. Any finished product containing the uncoated filament is subsequently ruined.

Figure 2:
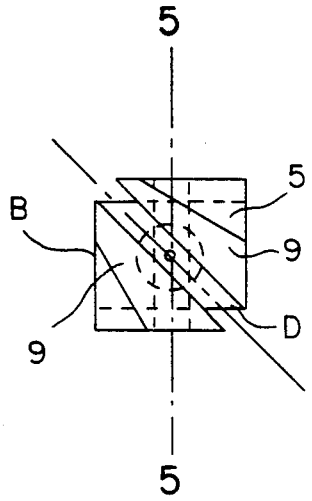
FIG. 2 is a top surface view of the applicator trap guide of the invention.
Figure 7:
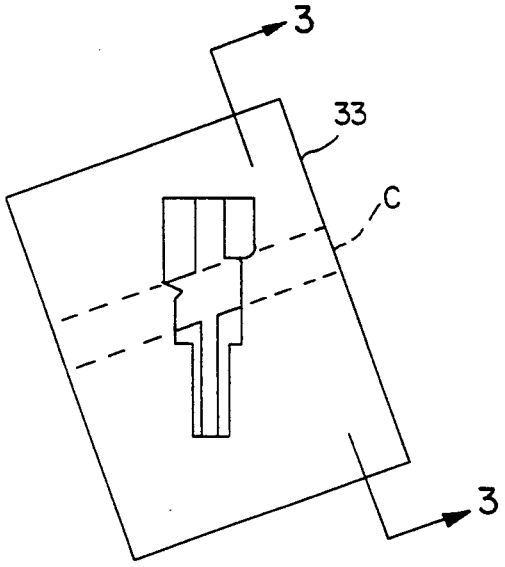
FIG. 7 is an elevation view of the unmachined block showing the traversing filament chamber in relative position to the unmachined trap guide applicator.

FIGS. 2 and 7 illustrate a novel trap guide applicator in accordance with the invention. The present invention overcomes the costly problem of filament slippage which played the prior art. Instead of an open guide taught by the prior art, a guide block B is provided which efficiently prevents a filament from accidentally disengaging from the guide. In addition to preventing filament slippage, the guide block B provides for visual monitoring and easy insertion of a filament within the guide block.

As the drawings illustrate, an applicator trap guide is provided including a cylindrical peg A which defines a longitudinal peg bore. A guide block B is attached to an upper surface of the peg A and in communication with the peg bore. The guide block defines an obliquely angled filament chamber C in communication with an entrance face and an opposing exit face of the guide block B, chamber C being in further communication with the bore of peg A. Guide block B defines further a fluted sleeve D above said filament chamber C and in diagonal communication, along line 2—2 as seen in FIG. 2, with the entrance and exit faces and being in further communication with the filament chamber C and having a pair of side walls which diverge upward forming opposing tapered surfaces converging with a top surface of the guide block B.

Figure 4:
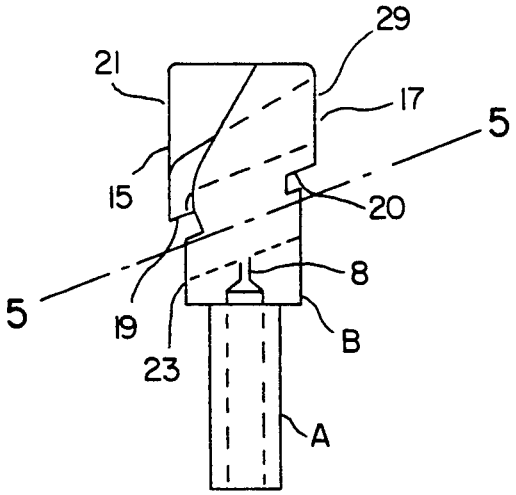
FIG. 4 is a side elevation of the applicator trap guide.
Figure 3:
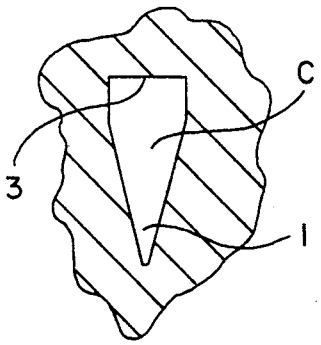
FIG. 3 is an elevation of the pentagonal filament chamber as present in an un-machined block.

In the preferred embodiment as seen in FIG. 3, filament chamber C defines a pentagonal structure with a lower V-shaped notch 1 and a rectangular upper surface 3 for engaging filaments along a line 5—5 as seen in FIG. 4. In reference to the guide block B, the preferred angle of the guide filament chamber C is 20 degrees. This angle allows sufficient engaging tension to be exerted on the filament without excessive wearing of the filament chamber C.

The fluted sleeve D (FIGS. 2 and 5), being in communication with the lower filament chamber C, allows a length of filament (not pictured) to be placed within chamber C without the need of threading an end piece of filament through the trap guide. Instead, a filament is placed over a bisected top surface 5 of guide block B, into the fluted sleeve D and then positioned into filament chamber C. Normal operating tension produced by the angled filament chamber C prevents the filament from escaping the filament chamber C.

Figure 6:
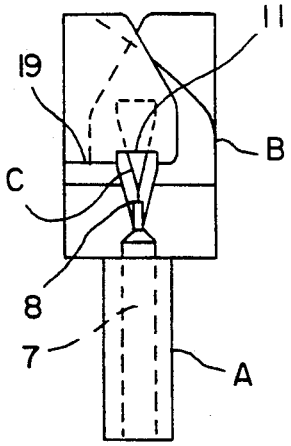
FIG. 6 is an elevation of the entrance face of the applicator trap guide.

As the filament passes through the filament chamber C, a coating is supplied through the longitudinal peg bore 7 which is in communication with the lower surface 1 of the filament chamber C. In the preferred embodiment, as best seen in FIG. 5 and 6, the peg bore 7 tapers to a reduced diameter orifice 8, which imparts a finer coating spray to filament chamber C.

Figure 5:
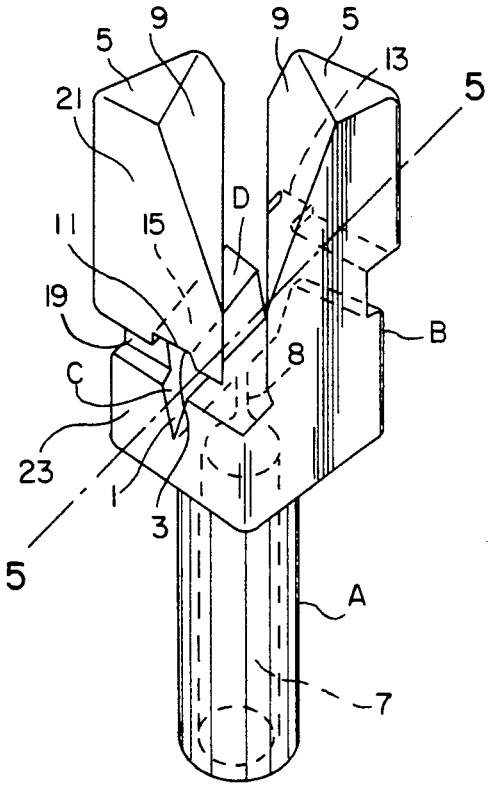
FIG. 5 is a perspective view partially in section of the claimed invention showing further the constructive pressed block in phantom view.

As seen in FIG. 5, a pair of side walls 9 of sleeve D form a divergent tapered surface before terminating with the top surface 5 of the guide block B. The tapered surface 9 allow both easier monitoring and insertion of a filament within the filament chamber C.

Additional protection against filament slippage is provided by an entrance notch 11 (FIG. 5 and 6) and an exit notch 13 on the respective entrance face 15 and exit face 17 of the guide block B. The respective notches preclude lateral slippage of the filament from the upper rectangular surface 3 of the filament chamber C. The entrance notch 11 is provided by a rectangular entrance trough 19 which traverses the entrance face 15 in a horizontal fashion near the upper surface 3 of the filament chamber C. The trough 19 is set at an oblique angle corresponding to the angle of the filament chamber C and is in communication with the fluted sleeve D and the filament chamber C. Where the trough 19 intersects the filament chamber C, the upper rectangular surface 3 of the filament chamber C defines the entrance notch 11. A similar exit trough 20 on the exit face 17 forms the exit notch 13.

The entrance trough 19 divides the entrance face 15 into an upper facet 21 and a lower facet 23. The upper facet 21 defines an outer plane parallel to a subtending plane of the lower facet 23 (FIG. 4). A similar upper facet 29 and a lower facet 31 is defined by the exit trough 20 on the exit face 17 of the trap guide.

The trap guide is preferably constructed of ceramic for its high abrasion resistance. The preferred method of producing the ceramic applicator trap guides is to press a block of ceramic 33 (FIG. 7) around a traversing pentagonal mandrel (not shown). The mandrel is removed from the pressed block 33, creating the filament chamber C as seen in FIG. 3 and as indicated by broken lines in FIG. 7. The ceramic block 33 is then bored, forming the peg bore 9 and reduoed diameter orifice 11. The trap guide applicator is then machined out of the pressed ceramic block 33 using standard machining techniques. Following machining, the ceramic trap guide is fired to harden and strengthen the ceramic.

It is thus seen that the instant invention provides an applicator guide for directing newly synthesized filaments to a source of protectant. It is further seen that this invention provides a means of securing the filaments against disengagement from the application trap guide while allowing visual monitoring of the coating process. Finally, it has been demonstrated that the applicator trap guide can be manufactured from ceramic. As many variations are apparent to one skilled in the art from reading the above specification, such variations are within the spirit and scope of the instant invention as defined by the following appended claims.

That which is claimed:

1. The method of producing a ceramic applicator trap guide which comprises the steps of:

pressing a ceramic around a mandrel to form a block defining a filament chamber;

removing the mandrel;

boring a hole through said block tapering to a reduced diameter orifice in communication with said chamber;

maching said block to form the trap guide which has the following features; in a cylindrical peg housing said bored hole, an entrance face in communication with said filament chamber having an upper facet on a plane parallel to a subtending lower facet, said upper and said lower entrance facets separated by a horizontal through in communication with said chamber and a diagonal fluted sleeve, said sleeve having a pair of side walls which diverge upward forming opposing tapered surfaces coverging with a trap guide top surface, and an opposing exit face in communication with said chamber having an upper facet on a plane parallel to a subtending lower facet, said upper and said lower exit facets separated by a horizontal trough in communication with said chamber; and firing said block to harden and strengthen the ceramic.

* * * * *